United States Patent [19]

Ford

[11] 4,083,577

[45] Apr. 11, 1978

[54] SKIS

[76] Inventor: Howard Ford, Les Abeilles, Boulevard d'Italie, Monte Carlo, Monaco

[21] Appl. No.: 691,302

[22] Filed: Jun. 1, 1976

[51] Int. Cl.[2] ..... A63C 5/04

[52] U.S. Cl. ..... 280/609; 280/608

[58] Field of Search ..... 280/609, 608, 604

[56] References Cited

U.S. PATENT DOCUMENTS

| | | | |
|---|---|---|---|
| 1,551,620 | 9/1925 | Ricke | 280/600 |
| 1,723,693 | 8/1929 | Froholm | 280/608 |
| 3,063,728 | 11/1962 | Patterson | 280/608 |
| 3,304,095 | 2/1967 | Carlton | 280/609 |
| 3,498,626 | 3/1970 | Sullivan | 280/610 |
| 3,814,417 | 6/1974 | Catlin | 280/609 |
| 3,944,239 | 3/1976 | Hastings et al. | 280/608 |

FOREIGN PATENT DOCUMENTS

| | | | |
|---|---|---|---|
| 959,874 | 12/1974 | Canada | 280/608 |
| 1,162,657 | 9/1958 | France | 280/609 |
| 1,339,600 | 9/1963 | France | 280/609 |
| 2,042,380 | 3/1972 | Germany | 280/608 |
| 2,227,980 | 1/1974 | Germany | 280/609 |
| 2,403,944 | 7/1975 | Germany | 280/608 |
| 2,064,223 | 7/1971 | Germany | 280/609 |
| 494,087 | 5/1954 | Italy | 280/609 |
| 174,689 | 1/1935 | Switzerland | 280/609 |

*Primary Examiner*—David M. Mitchell

*Attorney, Agent, or Firm*—Cushman, Darby & Cushman

[57] ABSTRACT

The present invention relates to skis in which resistance to turning is reduced and grip is improved by providing a running surface having a shape along at least substantially its whole length such that in cross-section at right angles to the longitudinal axis of the ski, the surface is predominantly convex across its width and, at the boot position, running along a part of each side of the ski, elongated blades positioned at least substantially symmetrically in relation to the boot position along the ski, the blades being parallel to the longitudinal axis of the ski and each blade projecting downwards from the sides of the ski by a distance substantially the same as the maximum projection of the running surface below the sides of the ski.

7 Claims, 13 Drawing Figures

FIG. 1
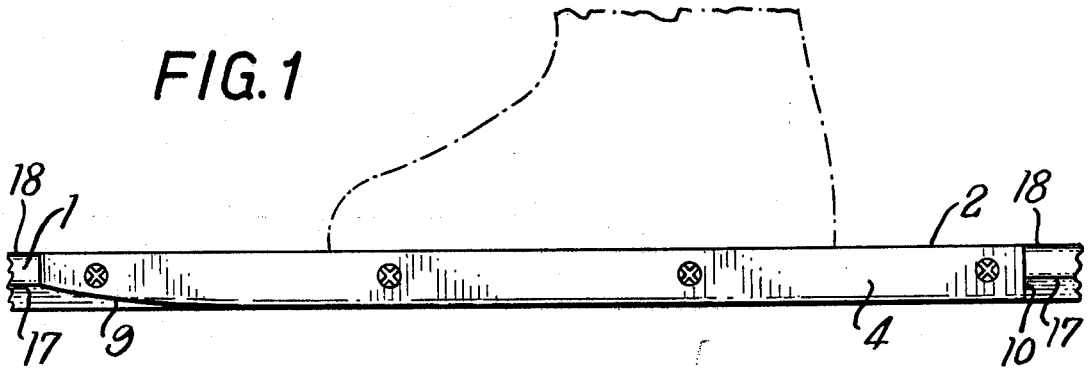
FIG. 2
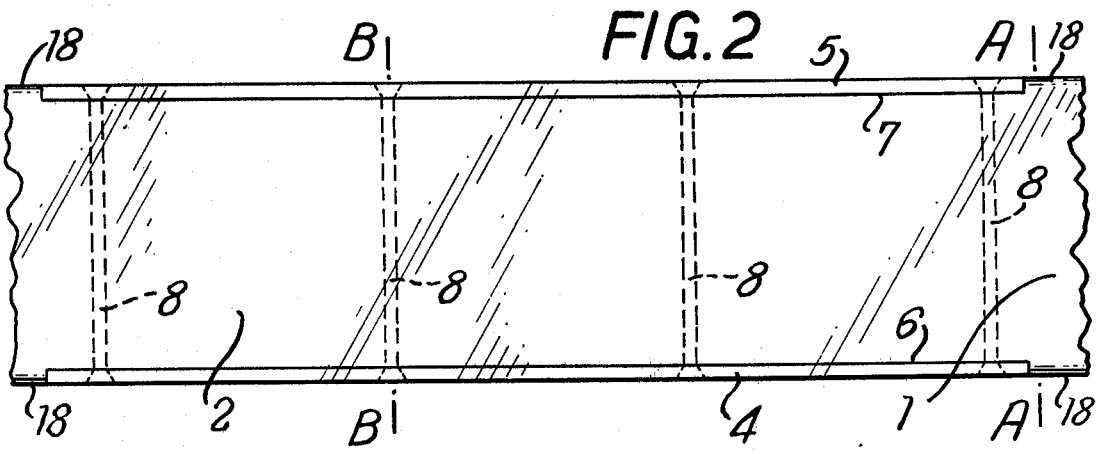
FIG. 3
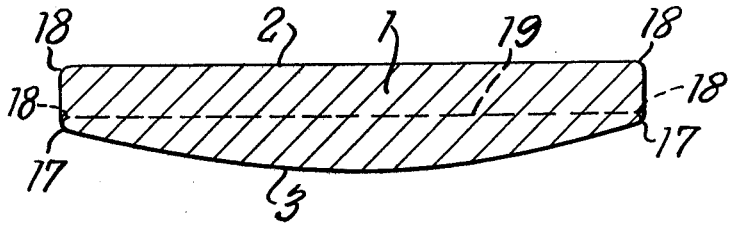
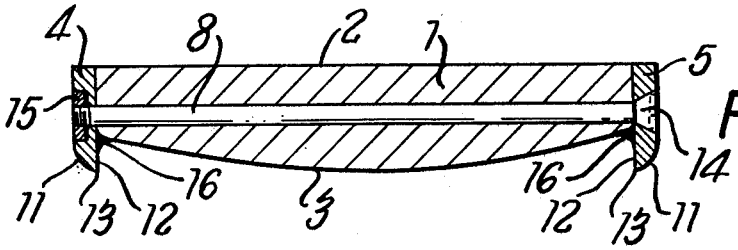
FIG. 4

SKIS

The present invention relates to skis.

I have found that by providing a particular shape of ski running surface such that in transverse cross-section substantially throughout its effective length the running surface is predominantly convex instead of flat, together with a comparatively short length of edge blades made prominent by this convex-shaped running surface, the usual relationship between the resistance of skis to turning on the piste and their resistance to lateral skidding can be radically altered so as greatly to reduce resistance to turning and at the same time to provide much improved grip of the snow to control side-slip and skidding.

Accordingly, the present invention provides a ski, wherein that face of the ski which in use provides the running surface has a shape along at least substantially the whole length of the running surface such that in cross-section at right angles to the longitudinal axis of the ski the running surface is predominantly convex across its width; and the ski having at the boot position, running along a part of each side of the ski, an elongated blade positioned at least substantially symmetrically in relation to the boot position along the ski, the blades being parallel to the longitudinal axis of the ski and each blade projecting downwards from the sides of the ski by a distance substantially the same as the maximum projection of the running surface below the sides of the ski.

The combination of a convex running surface together with downward protruding edge blades which are relatively short compared with conventional edges can be applied with advantage to most types of skis, in particular to:

TOURING SKIS, of length and bearing area sufficient for deep soft snow. Here the features of the invention provide for ease of maneuver on the piste to match that of very short skis.

RACING SKIS, which are normally of medium length and therefore shorter than touring skis. These too benefit from reduced resistance to turning, but even more so from the improved grip of the edge blades, both these features leading to the saving of vital time in every turn, crucial in a slalom.

VERY SHORT SKIS, such as are popular in the Spring when crusted snow prevails and a skier must often await the softening by the sun of the top layer of crust. These Spring skis, already fairly easy to turn, benefit usefully in that respect, but primarily from the much improved grip on crusty and icy surfaces.

SPECIAL CATEGORY SKIS, such as Langlauf Skis and Children's Skis can also benefit as described in detail below.

It will facilitate the description of the invention and an understanding of the new and simplified techniques of turning it makes possible to consider first some of the dynamics entailed both with the present ski and also with conventional skis.

Since edging skis to the right is to oppose skidding to the left, and edging them to the left is to oppose skidding to the right, it will be appreciated that with conventional skis, the edges, which are the sharpened corners of the running surface at the bottom of the skis' rectangular transverse cross-section, are geometrically inefficient until the skis have been edged through a substantial angle. They are, however, embarassingly effective in opposing the initiation of a turn, especially as, to ensure that the whole length of the running surface contributes fully to the edging effect, the "arching" and the stiffness of the ski are chosen to give the front and rear extremities of the running surface at least, and sometimes rather more than, their full share of the skier's weight. Turning of the ski is therefore opposed by resistance from the whole length of the running surface, but mainly from its extremities, of which the front is much the more important because it is always in the lead and tends to catch in the snow, whereas the rear is always trailing e.g. moving to the left in a right turn. So large in fact is this resistance that it is customary to unweight the skis, at least partially, before applying a turning couple by a swing of the thighs.

With the skis of the invention, however, such preliminary unweighting is unnecessary. It suffices merely to edge the skis slightly in the desired direction — enough to lift the blades on the outside of the turn clear of the snow — and to apply a small lateral couple, the cutting edges of the two inside blades biting immediately, and digging deeper to oppose skidding as edging is increased. And as edging is increased, the turning couple is being provided more and more by the inward component of toe-up/heel-down pressures exerted with little effort by the skier simply by shifting his weight back onto his heels, which also results in moving the centre of rotation of the skis rearwards so that nearly the whole length of the blades is then in front of this centre of rotation, allowing their outer faces to ride easily across the snow because they are rounded as described below.

With the skis of the invention the criterion for the arching and stiffness of the ski body is that the middle part of the ski where the edge blades are positioned should carry at least its share of the skier's weight, leaving for the front and rear of the ski only their bare share of the weight load. This apportionment, while ensuring that the underfoot section of the ski is always adequately weighted, gives a nearly uniform bearing pressure along the running surface, thus avoiding peak pressures that would increase the drag. It follows that for the production of skis in sized batches the weight used in stressing calculations should be the lowest for each size bracket, not the mean.

In addition to the unconventional design features already specified the skis may further differ from conventional skis in that in a plan view they should preferably be parallel sided instead of "waisted". This is because for any particular frontal width of the skis this increases the purchase of the edge blades at no extra cost in snow resistance.

The edge blades of the skis of the invention resemble the blades of ice-skates but unlike such blades need only one edge, that formed by the intersection of their outer and inner faces at their bottom extremity, this constituting the cutting edge of the blades. In length the blades must be sufficiently long to provide, in conjunction with their depth, a large enough resistance to lateral skidding to afford the desired grip; at the same time the length will be kept as short as possible to achieve maximum ski manoeuvrability on hard snow. Typically the blades will have a length about twice that of the boot, preferably a little shorter than this when large convexities are employed, but longer than this with small convexities.

Since the edge blades are short instead of running along the whole length of the running surface as do conventional edges, they have relatively a short moment arm in torque and correspondingly less force is needed to make the ski turn. Moreover, rounding the outer face of the blades, as explained above, further reduces this force. Although short (in length) in comparison with conventional edges the effectiveness of these edge blades is greater because they "bite" immediately and dig-in further, presenting a greater area to the snow to oppose skidding.

The blades may have a variety of shapes provided they can enter the snow easily to the front and from above with little snow resistance and provide a bottom cutting edge where their outer and inner faces meet.

In cross-section, however, it is important that the lower part of the blades' outer faces should be fully rounded because that, at no cost, reduces still further resistance to turning as already explained. It also gives added bite to the cutting edge.

Typically, therefore, the blades may have a half "U" section to provide this rounded outer face with the inner face provided by the flat vertical face of the half "U". Preferably, however, this rounded outer face is combined with an inner face inclining away from the outer face upwards from the cutting edge up to a maximum of some 35° from the vertical, this inner face being either flat or concave or a combination of these shapes.

In side view the front ends of the edge blades preferably curve gently upward from their cutting edge to give low-resistance snow entry. Their rear ends, however, are best cut square or essentially square because the sharp corners so formed constitute a valuable aid to climbing in that they will tend to dig into the snow to oppose slipping back and, by edging the skis, this digging-in can be increased substantially to make possible a steeper angle of climb.

The blades may be made as an integral part of the ski or may be attached thereto by any convenient means which will securely hold them in place under the arduous conditions of use, typically by a plurality of bolts or tie-rods passing through the skis, or by a plurality of dowels, screws or bolts securing them underneath the skis to the running surface.

The edge blades may be made of any material of sufficient strength and toughness to provide a reasonable life in use. Thus, for example, the blades may be made of plastics material, with or without metal inserts to strengthen them, but for the highest possible performance are preferably made of metal such as stainless steel or, to save weight, duralumin or titanium.

When the ski body is made of plastics material, wood or the like the blades conveniently may be formed as an integral part of the body. While such integral blades are less generally applicable than the preferred metal blades, they may be more convenient in the case where comparatively long blades are used with small convexities.

It will be appreciated that it is the inner face of one or other of the edge blades which reacts with the snow to arrest side-slip and that the effectiveness of a blade in achieving this depends partly on the detail of its cutting edge, but mainly upon the area it presents to the snow. Thus, in providing a sufficient area of edge blade to give the desired control over skidding, a consideration of prime importance is that depth of blade can save length, for in the present skis it is to the length of the blades and no longer to the full length of the ski running surface that resistance to turning is now roughly proportional. Thus, shortness of blade has great merit.

However, in seeking to minimize blade length by increasing blade depth there are practical limitations. Thus, if the blades protrude to a level below that of the low point of the running surface they would, when running straight, always be digging into the snow and setting up an undesirable drag as well as causing excessive longitudinal stability, like running on tram lines. It is preferable, therefore, that the depth of the blades should be sufficient, but only just sufficient, for them to make definite imprints on very hard snow when running straight, thus providing at minimum cost in drag a necessary measure of positive longitudinal stability and also ensuring that the edges are on instant call but not over-obtrusive when not wanted for "edging".

On the other hand, while the blades can in effect be made "taller" by increasing the convexity of the running surface cross-section between the two inner faces of the blades thereby to expose more of the blades, if carried too far this would lead to unacceptable disadvantages. Thus, one limiting factor is that the "taller" the blades the stronger their fixing arrangements must be made and the thicker will be the ski, with attendant weight penalties. Another potential limit will be imposed by the consideration that steep curvature towards the ski sides would wastefully decrease the effective bearing area of the skis in soft snow because a good deal of snow would be deflected sideways instead of compressed underneath, so necessitating, for touring skis anyway, an increase in this bearing area, again entailing a weight penalty and additionally a drag penalty. A further important limitation is that excessive convexity leads to an increase in the bearing pressure along the bottom (or sole) of the running surface, causing the ski to sink in more with attendant drag increase.

In the skis of the invention however, it is not necessary to employ a convexity that is awkwardly large for it will suffice if the ski sides are high enough above the running surface low-point to keep them clear of the snow during the initial phase of a turn, generally until the ski has been edged through an angle of some 15° to 25°. The turn by then is well under way and the skier is in a strong posture to exert any forces necessary to complete it. When the skis are edged beyond this angle (hereinafter termed a clearance angle) the ski sides become potential auxiliary edges and can be suitably reinforced to fulfil that function, augmenting the main resistance to skidding provided by the edge-blades and doing so without significantly increasing resistance to turning. Such auxiliary edges will play little part in normal turns but will certainly be useful in high speed "stop turns" and for example, when "stemming" down a steep path too narrow to permit manoeuvre.

Even the considerable convexity which is desirable to take full advantage of the invention can be provided, by the specific arrangements to be described, without incurring any serious loss of bearing area and without attracting other penalties.

The running surface preferably has a uniform or nearly uniform cross-section along substantially its whole length apart from the upturned tip of the ski. Preferably also the convexity of the cross-section is such that the ski is markedly lower at a point midway between the ski sides (its mid-width) than at the sides themselves. In addition, it is preferred that the cross-section over the whole or substantially the whole distance from one side of the ski to the other is a smooth composite curve which is predominantly convex but may include straight and concave segments.

Thus, the predominantly convex cross-section may have a radius of curvature that is constant or the radius of curvature may vary smoothly from a greater-than-average value at the ski mid-width (not excluding a radius of curvature up to infinity) to a smaller-than-average value towards the ski sides. Preferably, the curvature in cross-section from the ski mid-width outwards towards each side of the ski, with reference to a straight line tangential to the curvature at the mid-width, commences gently convex and steepens increasingly until, passing through a point of inflexion at from about one-half to two thirds of the distance in a straight line parallel to the reference line outwards from the mid-width, it becomes concave and continues concave until the tangent to its slope becomes substantially parallel with the reference line, and then continues to the ski side substantially along the said tangent. In this preferred section the straight or substantially straight portions towards the ski sides provide short wings emerging each side from the tops of the shallow "U" of the downward bulged running surface between the edge blades.

Typically, the depth below the ski sides of the downward bulge at the ski mid-width may be between 1/5 and 1/15 of the ski width, preferably about 1/7 of this width for strong grip skis and about 1/12 for others.

The skis of the invention may be constructed from a variety of materials such as wood, plastics material, fibre-glass or metal, or combinations thereof.

Skis in accordance with this invention will now be described by way of example with reference to the accompanying drawings in which:

FIG. 1 is a side view of part of a ski in accordance with the invention,

FIG. 2 is a top plan view of the part ski of FIG. 1,

FIG. 3 is a cross-section along line A—A of FIG. 2 enlarged by a factor of two,

Figure 6:
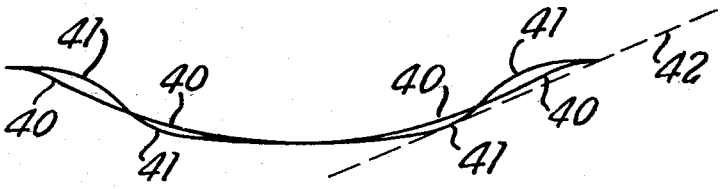
Figure 5:
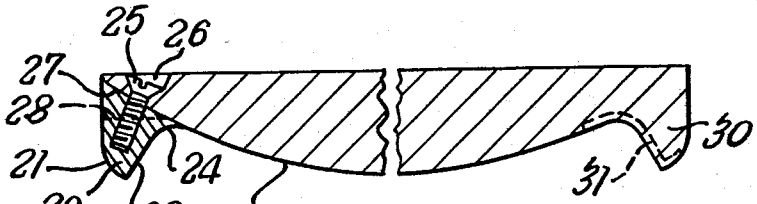
Figure 7:
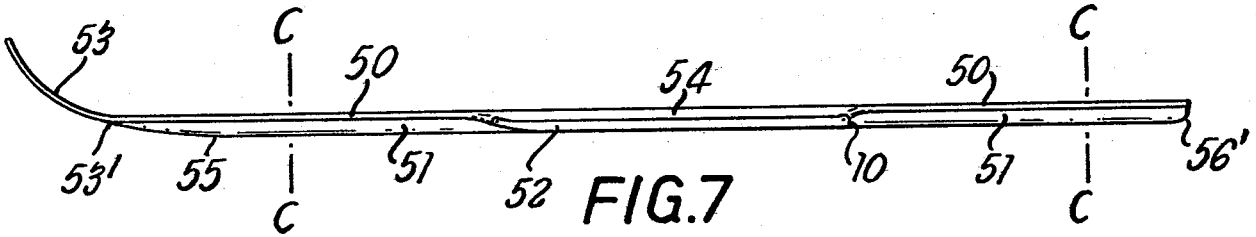
Figure 8:
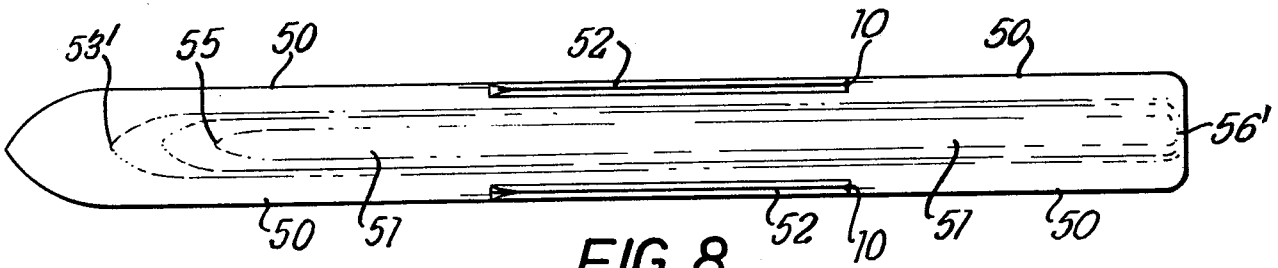
Figure 9:
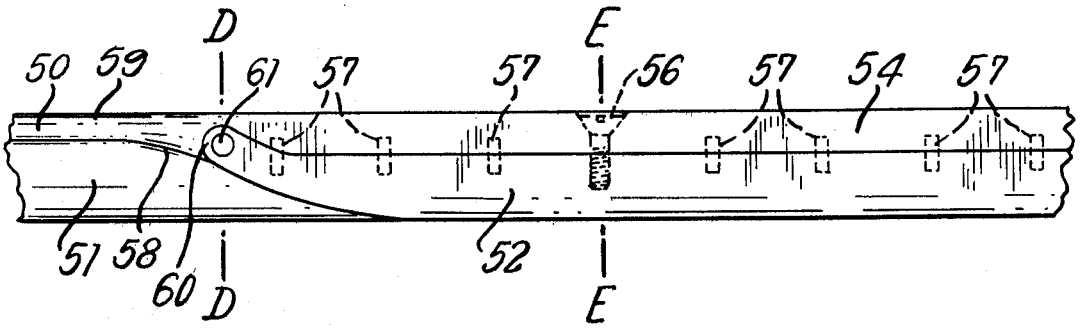
Figure 10:
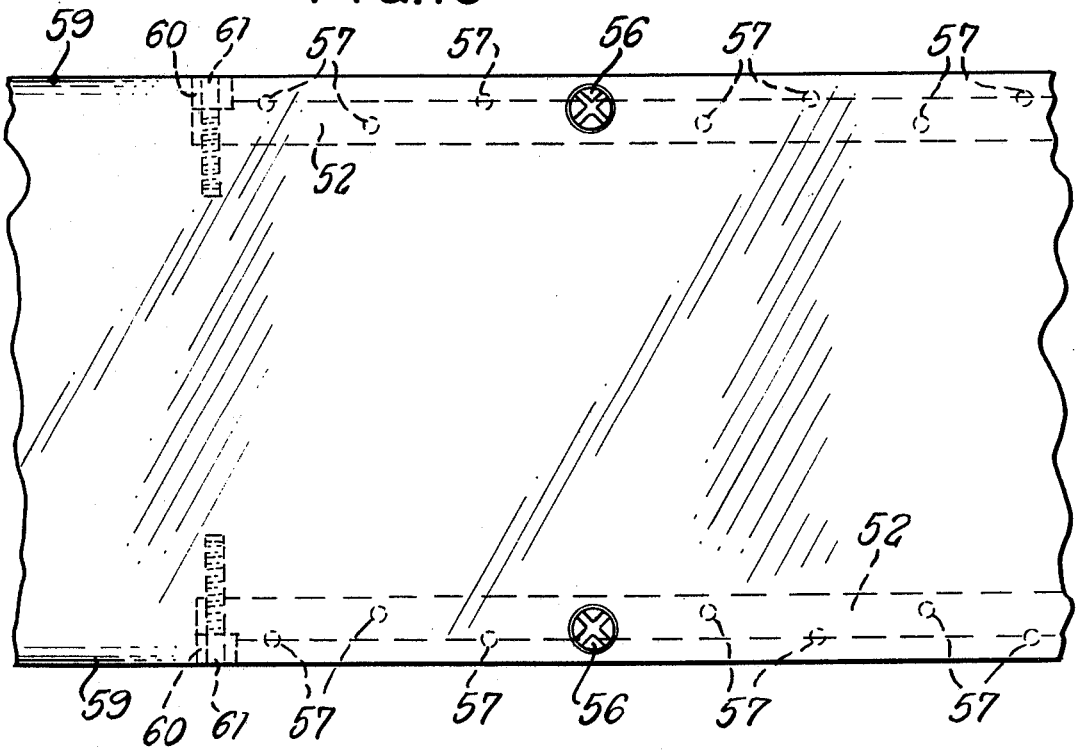
Figure 11:
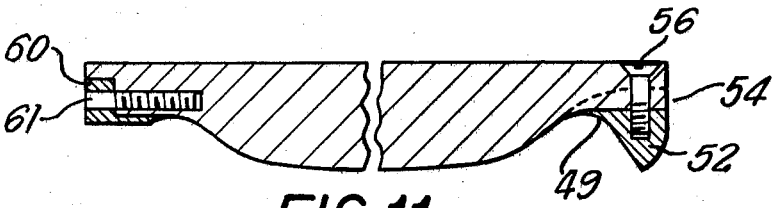
Figure 12:
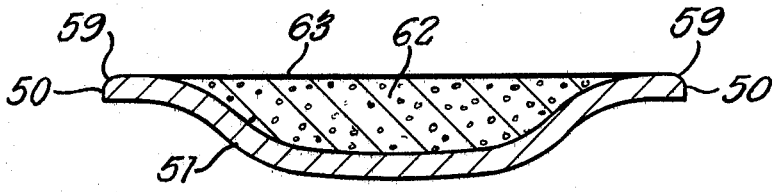
Figure 13:
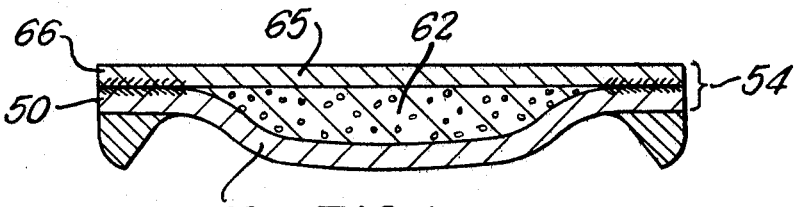

FIG. 4 is a cross-section along line B—B of FIG. 2 again enlarged by a factor of two, FIG. 5 is the same cross-section as FIG. 4 through a ski with approximately double the depth of running surface and showing two blade variants, FIG. 6 is a diagram showing two curved outlines superimposed to compare two alternative surfaces which are predominantly convex overall, FIG. 7 is a side view of a higher performance ski in accordance with the invention in which the vertical scale is twice the longitudinal scale and in which the ski is straightened longitudinally as if by skier's weight, FIG. 8 is an under-plan view of the ski of FIG. 7 in which the width scale is similarly twice the longitudinal scale, FIG. 9 is an enlarged side view of part of the ski of FIG. 7 to illustrate the front half of the edge blades, FIG. 10 is a top plan view of the part ski of FIG. 9, FIG. 11 is a composite of cross-sections at lines D—D and E—E of FIG. 9, FIG. 12 is an enlarged cross-section along lines C—C of FIG. 7 to the same scale as FIG. 11, FIG. 13 is a cross-section at the boot position to illustrate another method of construction of the same ski as in FIG. 7.

Referring to FIGS. 1 to 4, the part of a ski shown is the central part and comprises a ski body 1 having a flat upper face 2 and a lower face 3, which provides the ski running surface, shaped to a convex section as shown. At the boot position (shown dotted in FIG. 1) blades 4 and 5, preferably made of stainless steel, are positioned in recesses 6 and 7 respectively let into the sides of the ski body 1. The blades 4 and 5 are held firmly in place by bolts 8 passing through the ski body 1 and they have a length about twice that of the boot.

Referring to FIG. 1, it can be seen that the blades 4 and 5 have an upward curving front portion 9 and a square-cut rear end 10.

Referring to FIG. 4 it can be seen that the blades 4 and 5 project downwards at the ski side from the face 3, and the projecting blade portions have a curved outer face 11 and a flat inner face 12 which meet at a sharp cutting edge 13. Also the bolts 8 securing the blades have heads 14 and nuts 15 countersunk within the blades and the re-entrant corners at the junction between the face 3 and the blades 4 and 5 are rounded with hard wax or similar fillets 16 to guard against the jamming there of snow or ice. Similarly, the sides of the blades can be smoothed with hard wax, making good any roughness in the vicinity of the recesses 6 and 7 and of the bolt heads 14 and the nuts 15.

Referring to FIGS. 1 and 3 it can be seen that beyond the blades 4 and 5 the ski body at its sides has slightly rounded corners 17 and 18 adjacent the lower convex face 3 and the upper face 2 respectively. In FIG. 3 the dotted line 19 indicates the position of the top of the ski near its front and rear extremities at its shallowest depth. When greater depth of ski near these extremities is required, this can be provided, without weight increase, by bending up the ski sides in a hot-press or the like.

Since in the ski shown the running surface provided by face 3 is convex instead of flat and the ski side corners 17 and 18 are rounded, virtually the only resistance to turning (as well as to side-slip) is that provided by the edge blades 4 and 5. These being only about twice the length of the boot, instead of running along the whole length of the running surface as do conventional edges, possess, relative to such conventional edges, a very short moment arm in torque and need correspondingly less force to make them turn. Moreover, this force is still further reduced due to the fact that when the skis are slightly edged in the direction of a desired turn and a small couple in that sense is applied by toe and heel, those portions of the edge blades which are in front of the centre of rotation of each ski will ride smoothly over the snow by virtue of the rounded outer faces of the blades in contact with the snow, and the skier can exploit this easement by transferring most of his weight onto his heels, so bringing the centre of rotation of each of his skis rearwards and increasing the proportion of the blades in front of the centres of rotation. This provides for a very easy and natural turning technique, for as the angle of edging is increased the inward couple is provided more and more by a toe-up/heel-down pressure which the foot and leg muscles are well endowed to exert.

The upward curving fronts of the blades 9 also assist when initiating a turn, since the mere edging of the skis in the desired direction gives rise to a slight tendency to turn.

As can be seen from FIG. 4 the convexity of the running surface face 3 gives prominence to the blades 4 and 5, exposing their inner faces 12 and cutting edges 13 which are given increased "bite" by the rounding of the blade outer faces 11.

This bite comes into action to oppose side-slip and centrifugal skidding instantly as the skis are edged and builds up steadily as the edging is increased and the blades dig deeper in the snow. Moreover, the amount of this edging is undiminished by any torsional twisting of the skis towards front and rear. So the blades, although but a small fraction of the length of the running surface, are more efficient than conventional edges in controlling centrifugal skidding. They are quicker acting in that their effect starts sooner than with conventional edges, and builds up quicker. Furthermore, the convexity of the face 3 makes it physically much easier to apply the edges, for this now requires but a simple rolling action, demanding much less effort from the skier, a valuable easement particularly for the many quick reversals of direction entailed in a slalom. Thus time is saved in every turn.

Referring to FIG. 5 this shows two edge blade variants combined with a lower face 23 of increased convexity. On the left-hand side is shown an edge blade 20 which is broader than blades 4 and 5 of FIG. 4 because its outer face 21 has a greater radius of curvature and its inner face 22 is inclined inwards, away from the outer face, so that it is approximately "normal" to the running surface face 23. Here the rounding-off of the intersection between the blade face 22 and the running surface 23 achieved in the embodiment of FIG. 4 by the fillets 16, is achieved by a lip 24 integral with the blade 20. The lip 24 also serves to provide additional seating width at the top 27 of the blade which allows for fixing under the ski body by screws 25 passing through holes 26 (only one of each shown), the holes being filled and smoothed after the blades have been fitted. The location and security of each blade may be assisted by a plurality of dowels (not shown) positioned between the screws 25. If desired, these screws may be replaced by bolts protruding upwards from each blade top 27, with nuts and lock nuts tightened from above through the holes 26.

As a result of increasing the radius of curvature of the rounding of the blade's outer face and also as a result of inclining the blade's inner face some 35° from the vertical, which both increases its area and brings it approximately "normal" to the face 23, there is provided better snow-entry and more progressive effectiveness as edging is increased.

The mating surface provided at the blade top 27 is shown as a continuation of the convex line of the running surface face 23. However, the face 23 can alternatively and preferably here be horizontal as indicated by the dotted line 28 running outwards from just above the lip 24, thus providing additional strength to the centre section of the ski body to withstand the side loads on the blades. In this case the screws and other fixings become upright and to the front and rear of the blades the ski sides can revert to the contour shown by the unbroken line.

On the right-hand side of FIG. 5 there is shown a blade 30 which forms an integral part of the ski body. To strengthen the blade 30 and to provide it with a sharp cutting edge a metal plate 31 (shown dotted) can, if desired, be fixed in a recess under the blade by a plurality of screws (not shown).

Integral blades as shown may be advantageous for skis of shallow depth (which permits only small convexities), since these require blades of greater length, typically about half the length of the running surface. By making such blades integral with the ski body elaborate fixings can be dispensed with and large differential stresses between the ski body and blades when the ski flexes can be avoided.

For example, children's skis, usually short and relatively broad, would be well suited by a moderate convexity in association with integral blades (preferably with no metal inserts) about half the length of the running surface, which combination would make turning and stopping much easier, with no attendant risks of over-sensitivity to edging or of injury from the blades in a fall. Moreover, the climbing aid provided by the square cut rear end of the blades would be extremely useful on the nursery slopes.

Integral blades about half the length of the running surface, in association with moderate convexity, would also be advantageous in the case of Langlauf skis, also called Nordic skis. These skis, used for general long distance cross-country skiing and racing in tracks across gently undulating country, are very specialised being long, narrow and as light and drag-free as possible because the skier when poling along the flat has to accelerate his rear ski forward every one of a large number of strides (often many thousands) and needs to extend each stride by sliding as far as possible, so economy of effort is vital.

With such skis constructed in accordance with the invention, especially when embodying also the thin-shelled hollow body of FIGS. 12 and 13 as described below, there would be advantages in terms of weight reduction and reduction in drag. In downhill stretches the skis of the invention would provide an easy skidding technique for the small turns encountered in track running that would often be less fatiguing than the usual practice of "walking" round the turn. In the uphill stretches, the climbing aid provided by the square-cut rear ends of the blades would be valuable, saving the skier's arms and shoulders much arduous exertion in the use of his sticks.

Referring to FIG. 6, this applies to a cross-section a little forward or a little to the rear of the edge blades and shows two alternative outlines for the convex running surface.

Curve 40 is of constant radius until near each extremity it passes through a point of inflexion and then becomes concave before terminating in a nearly horizontal straight portion. This curve provides a useful datum against which to compare curve 41 which will be seen to reach its extremities co-incident with curve 40 but by a significantly different route, being of greater radius i.e., flatter, at the bottom, and then curving up more steeply and becoming concave sooner, before flattening out.

This curve 41 is much preferred to curve 40, having the advantage that its flatter sole provides a more stable and comfortable normal stance for the skier, and also reduces the bearing pressure, thus providing a faster ski. In addition, it prevents over-sensitivity of edge bite at small angles of edging and furthermore provides a larger clearance angle than curve 40. Only one of the clearance lines 42 is shown. It is tangential to the curve 41 and its inclination gives the clearance angle.

Moreover, the fact that the curve 41 becomes concave sooner, and thus forms side wings of greater length, provides more effective bearing area for soft snow. Such a composite curvature provides a two-tier running surface, the full area of which functions in soft snow, and a much smaller area on hard snow, virtually two skis in one — a versatility ideal for touring and other general purpose skis and useful also for racing skis, bearing in mind that races must sometimes perforce be run during or immediately after heavy snow falls.

Furthermore, by considerably increasing the convexity between the blades so as to increase the area of their inner faces sufficiently to inhibit centrifugal skidding altogether on the well-packed snow usually found on the piste and on slalom courses, there is made possible an entirely new type of turn, a "steered" parallel-ski turn that is the simplest and fastest possible, but which can readily be converted into a skid turn whenever it is desired to check excessive speed.

Referring to FIGS. 7 to 13, the ski shown embodies a running surface shaped to a curve similar to curve 41 of FIG. 6. Thus, the face 51 curved as shown provides a running surface having a flatter, more bulbous sole than that of per 40, together with side wings 50 which turn up in front at 53' to form the ski tip 53. The face 51 fully utilises the natural depth of the ski to provide an increased slant height of the inner faces of the edge blades amounting to about two and a half times that of the ski of FIGS. 1 to 4.

The side wings 50, as shown, run the full length of the ski but thicken in the centre section 54 above the blades 52 so as there to strengthen the ski-body to withstand side loads. At the front of the ski the face 51 emerges below the tip turn-up 53' and curves down gently, reaching its full depth at 55 so as to provide smooth snow-entry, economical in drag. At the rear of the ski the face 51 can be rounded as shown at 56, but preferably not as much as at the front of the ski. At the rear of the ski the face 51 can be rounded as shown at 56' in FIGS. 7 and 8.

Referring to FIGS 9, 10 and 11, the blades 52 can be seen attached to the ski below its thickened centre-section 54 by means of four strong bosses 61, a pair at the front and a pair at the rear of the blades (only the former being shown) which are screwed into the ski body to provide an anchorage capable of withstanding the large bending stresses generated there when the front of the ski flexes upward, as it should, on encountering soft snow or rising ground. The bosses 61 pass through flanges 60 provided at each extremity of each blade, which flanges are recessed into the ski sides (FIG. 11) and located so that as shown in FIG. 9 the sloping section 58, formed as the wings 50 thicken at the centre section 54, provides a fairing for the blades. The bottom corner of section 58 may be rounded as shown to prevent snow catching there.

The lateral location of the blades is provided by a plurality of dowels 57, slightly staggered laterally as shown in FIG. 10 to spread the load, and by two or more pairs of screws 56 (only one pair shown) which clamp the blades to the ski body centre-section 54.

As shown in FIGS. 9, 10 and 12 the top corners 59 of the side wings 50 are rounded since they serve no useful purpose if left square and might occasionally catch in the snow.

Referring to FIG. 11, this shows on its left-hand side a cross-section along the line D—D of FIG. 9 and on its right-hand side a cross-section along the line E—E of that Figure. As mentioned above it can be seen from the left-hand side of the Figure how each blade's front flange 60 is recessed into the ski side and mates with the boss 61.

On the right-hand side of the Figure the fixing of the blade 52 to the ski body centre-section 54 by screw 56 can be seen and the dotted line shows the higher level to which the ski side 50 reverts in front of and to the rear of its thickened centre-section 54.

It will be seen that advantage has been taken of the alternative and preferred running surface contour of FIGS. 7 to 12 to increase slightly to about 35° the inward inclination of each blades inner face, thereby significantly, and without prejudicing good snow entry, increasing the slant-height of this inner face so as to enlarge its area enough to inhibit centrifugal skidding in all but exceptionally fast or abrupt turns, thus making possible the new "steered" parallel ski turn already referred to. In addition, the lip 49 is more generously rounded although how this rounding is shared between the ski body and the blade is unimportant and best decided from the point of view of structural convenience.

In the case where the blades 52 are light-alloy castings, the screws 56 may if desired be replaced by bolts embedded in the casting and protruding upwards from it. The dowels 57 likewise may be part of the cast blade.

Referring to FIG. 12, it will be seen that to save weight the ski body forward and rearward of the centre-section may be hollowed out, consistent with strength and flexibility requirements. To prevent snow collecting in the hollowed out body it may be filled with a foam-like material 62, its top surface 63 being rendered glossy and waterproof.

As will be appreciated from the explanation already given, the raised ski sides 50 become potential auxiliary edges when the ski is edged beyond the clearance angle and, if desired, may be reinforced by any convenient means. Should the ski be constructed as a metal pressing the auxiliary edges will in fact be ready-made. Alternatively, if constructed as a fibre-glass or similar moulding, reinforcing of the edges may be effected by conventional means.

Referring to FIG. 13 this is a cross-section at the boot position intermediate between the two cross-sections of FIG. 11, and to the same scale, but omitting all details of the blade fixings. This Figure merely outlines schematically how a ski of the invention can be constructed as a metal pressing.

It will be seen that the body 48 is now a metal shell to whose side wings 50 is attached permanently (by rivetting or welding or similar means) a robust central platform 65 of about the same length as the edge-blades. Together wings 50 and sides 66 of the platform 65 form the thickened ski centre-section 54 of FIGS. 7 to 11. To the front and the rear of this thickened section 54 the wings 50 rise again to the level of the platform 65 which is thus effectively recessed into the wings. The hollow body is foam-filled in the same manner as the body of FIG. 12 and the body elsewhere along the length of the ski running surface may be as shown in FIG. 12.

The skis of the invention as described specifically above, by employing a combination of convex running surface and prominent edge blades short in length relative to conventional edges, can provide greatly increased manoeuvrability in use. In particular, by virtue of the lack of resistance to turning offered by the convex running surface and of the short moment arm in torque possessed by the edge blades and of their rounded outer faces, the force the skier must exert to effect a turn is much reduced, making turning simpler and less tiring. Also, edging the ski to arrest skidding is both much easier to apply, entailing merely a rolling over by the ankles on the convex running surface, and more effective because the edge blades start digging into the snow to oppose a skid from the very commencement of applying edge, quite unlike conventional edges which must be edged through a considerable angle before becoming really effective. Thus, vital time is saved in every turn, and quick reversals of direction are facilitated, crucial in a slalom.

As indicated the skis of the invention may be fabricated in any suitable material. For the larger convexities required to obtain the fullest benefit from the invention, mouldings in glass-fibre or metal pressings are both eminently suitable. At the same time, while these materials are suitable also for moderate or small convexities, in these cases construction in wood becomes very competitive.

I claim:

1. A ski having a longitudinal axis and a side disposed on either side of the longitudinal axis, and having a front upwardly curved end and a rear end with a boot position intermediate said ends, said ski comprising:

a ski face comprising the running surface, said face terminating at the ski sides and said face, substantially along the entire length thereof, being convex in cross-section at right angles to the longitudinal axis of the ski, so that said running surface projects below the sides of the ski;

the convex cross-section of the running surface having radii of curvature which vary smoothly from a large radius at the ski mid-width to a small radius towards the ski sides;

a pair of elongated blades, each blade having a length substantially less than the length of the ski and one blade mounted on each side of the ski at the boot position only, parallel to the axis of the ski and at least substantially symmetrical in relation to the boot position along the ski;

each blade projecting downwards from the sides of the ski a distance generally the same as the maximum projection of the running surface below the sides of the ski; and each blade having a top inner face provided with a smoothly rounded surface where the top inner face meets the running surface, said smoothly rounded surface curved so that at its extremities it is tangential respectively to the running surface and the blade face, whereby a smooth groove is defined affording a snow throughway from the front to the rear of the ski.

2. A ski having a longitudinal axis and a side disposed on either side of the longitudinal axis, and having a front upwardly curved end and a rear end with a boot position intermediate said ends, said ski comprising:

a ski face comprising the running surface, said face terminating at the ski sides and said face, substantially along the entire length thereof, being predominantly convex in cross-section at right angles to the longitudinal axis of the ski, so that said running surface projects below the sides of the ski;

the predominantly convex cross-section of the running surface having a curvature from the ski mid-width outwards towards each side of the ski which, with reference to a straight line tangential to the curvature at the mid-width, commences gently convex and steepens increasingly until, passing through a point of inflexion at from about one-half to two-thirds of the distance in a straight line parallel to the reference line outwards from the mid-with, it becomes concave and continues concave until the tangent to its slope becomes substantially parallel with the reference line, and then continues to the ski side substantially along the said tangent;

a pair of elongated blades, each blade having a length substantially less than the length of the ski and one blade mounted on each side of the ski at the boot position only, parallel to the axis of the ski and at least substantially symmetrical in relation to the boot position along the ski;

each blade projecting downwards from the sides of the ski a distance generally the same as the maximum projection of the running surface below the sides of the ski; and each blade having a top inner face provided with a smoothly rounded surface where the top inner face meets the running surface, said smoothly rounded surface curved so that at its extremities it is tangential respectively to the running surface and the blade face, whereby a smooth groove is defined affording a snow throughway from the front to the rear of the ski.

3. A ski having a longitudinal axis and a side disposed on either side of the longitudinal axis, and having a front upwardly curved end and a rear end with a boot position intermediate said ends, said ski comprising:

a ski face comprising the running surface, said face terminating at the ski sides and said face, substantially along the entire length thereof, being convex in cross-section at right angles to the longitudinal axis of the ski, so that said running surface projects below the sides of the ski;

a pair of elongated blades, each blade having a length substantially less than the length of the ski and one blade mounted on each side of the ski at the boot position only, parallel to the axis of the ski and at least substantially symmetrical in relation to the boot position along the ski;

each blade projecting downwards from the sides of the ski a distance generally the same as the maximum projection of the running surface below the sides of the ski; and each blade having a front end and a rear end, each blade front end disposed toward said ski front end, and each blade rear end disposed toward said ski rear end; and means for facilitating climbing with the ski, said means comprising a right-angle termination of the rear end of each of said blades.

4. A ski as recited in claim 3 further comprising a curved termination of the front end of each of said blades.

5. A ski having a longitudinal axis and a side disposed on either side of the longitudinal axis, and having a front upwardly curved end and a rear end with a boot position intermediate said ends, said ski comprising:

a ski face comprising the running surface, said face terminating at the ski sides and said face, substantially along the entire length thereof, being predominantly convex in cross-section at right angles to the longitudinal axis of the ski, so that said running surface projects below the sides of the ski, greatly reducing the resistance of the ski to turning;

a pair of elongated blades, each blade having a length substantially less than that of the running surface of the ski and one blade affixed on each side of the ski at the boot position, parallel to the axis of the ski and at least substantially symmetrical in relation to the boot position along the ski;

each blade having, facing the longitudinal axis, an inner face exposed by the convexity of the running surface so as to provide grip to prevent or very substantially limit side slip and skidding of the ski, and, facing away from the longitudinal axis, an outer face which is rounded in order to reduce its resistance to movement across snow in the outward direction and thus to reduce further the resistance of the ski to turning, the said inner and outer blade faces meeting at a bottom cutting edge which runs parallel to the longitudinal axis; and each blade projecting downwards from the sides of the ski a distance generally the same as the maximum projection of the running surface below the sides of the ski.

6. A ski as recited in claim 5 wherein the inner face is inclined away from the outer face upwards from the cutting edge at an angle of up to about 35° from the vertical.

7. A ski as recited in claim 5 wherein the depth below the ski sides to which the convex running surface projects at ski mid-width is between 1/5th and 1/15th the width of the ski at ski mid-width.

* * * * *